United States Patent [19]

Carranza

[11] 4,166,357

[45] Sep. 4, 1979

[54] METHOD OF MAKING ROPE

[75] Inventor: William L. Carranza, Miami, Fla.

[73] Assignee: Sunshine Cordage Corporation, Miami, Fla.

[21] Appl. No.: 797,249

[22] Filed: May 16, 1977

[51] Int. Cl.[2] ..... D02J 1/22

[52] U.S. Cl. ..... 57/310; 57/282; 264/210.2

[58] Field of Search ..... 57/34 R, 34 HS, 36, 57/55.5, 157 R, 157 S, 157 TS, 157 MS, 160, 144, 6; 264/103, 210 R, 210 F, 290 R, DIG. 76

[56] References Cited

U.S. PATENT DOCUMENTS

| | | | |
|---|---|---|---|
| 3,048,963 | 8/1962 | Himmelfarb et al. | 57/157 R X |
| 3,164,947 | 1/1965 | Gaston | 57/157 S X |
| 3,164,948 | 1/1965 | Stratford | 57/157 S X |
| 3,266,232 | 8/1966 | Dawbarn et al. | 57/157 S |
| 3,309,862 | 3/1967 | Hood | 57/6 X |
| 3,402,547 | 9/1968 | Parsey | 264/216 F X |
| 3,481,136 | 12/1969 | Timmons et al. | 57/157 S X |
| 4,002,711 | 1/1977 | Peters | 264/210 F X |

*Primary Examiner*—Donald Watkins
*Attorney, Agent, or Firm*—Cushman, Darby & Cushman

[57] ABSTRACT

Filaments are extruded from polyolefin. A plurality of filaments are formed into a strand by twisting. The twisted strand is is twisted with other strands to form a rope which retains its tensile strength and reduces elongation. The filaments are made into strands before the heat introduced during extrusion has completely dissipated.

2 Claims, 3 Drawing Figures

METHOD OF MAKING ROPE

This invention relates to a cordage product and a process for making it, and more particularly to a new process for making a synthetic polypropylene and/or polyethylene rope product from polyethylene and/or polypropylene filaments. This invention is an improvement over the invention of U.S. Pat. No. 3,839,854.

Rope is produced from vegetable and synthetic fibers. In the case of continuous filament rope products made from synthetic polymers, particularly polypropylene and polyethylene filaments, the rope is made in three stages. First, a yarn is made by twisting together a bundle of fibers, this step imparting the "primary twist." Two or more yarns are then twisted together in the opposite direction from the primary twist to make a strand and several strands are twisted together to make the rope.

The first step, that is the step of imparting a primary twist to the yarn, has been considered a necessary step because polypropylene and polyethylene fibers are very stiff and have low memory, tending to unravel, and come fully apart in the subsequent operations of making the strands, and on closing the strands to make the final rope products. The primary twist helps the strands to remain firm, and a satisfactory rope product is produced. However, imparting primary twist to the synthetic polypropylene and polyethylene yarn constitutes an expensive manufacturing step, and creates a requirement for expensive equipment.

In U.S. Pat. No. 3,839,854 an invention was described which provided a process for manufacture of novel and improved synthetic polypropylene and polyethylene rope products, without the necessity of introducing a primary twist to the yarns. The process described is simple, fast and much less expensive than the conventional process in which a primary twist is imparted to the yarn. In accordance with that process, a bundle of filaments, without any twist having been imparted previously, is twisted into a strand, e.g. on a conventional former rope machine. As the strands are being made, the twist imparted into the strand is heat set before the next step, preventing further unraveling during the subsequent operation of "closing" the strands into a rope product.

The present invention is based on the discovery that, in carrying out the process of U.S. Pat. No. 3,839,854, it is possible to avoid the application of heat to the bundle of filaments or the strand at the time the strand is made.

The invention may be applied to filaments of polyolefin, especially filaments of polyethylene, polypropylene, or blends thereof, and copolymers of ethylene and propylene. The filaments may be melt spun and may have any cross-section, including round, square or the like. They also may be ribbons severed from films, and may be blown filaments of the kind described in U.S. Pat. No. 3,315,454. The filaments ordinarily will be oriented for strength.

In general the filaments will be about 65 to 1,650 denier. The strands made by twisting bundles of filaments will be 22,500 to 1,080,000 deniers, and the rope may be 67,500 to 3,240,000 deniers. The size of strands in the rope will vary according to the size of rope desired.

The invention will be better understood from the following detailed description of preferred embodiments, reference being made to the drawing, in which.

Figure 1:
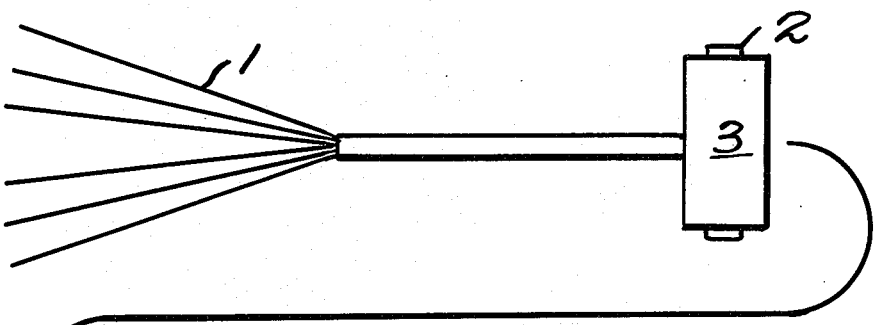
FIG. 1 is a schematic view, showing the formation of untwisted filaments and temporary winding of them in packages in preparation for use in the process of the present invention.

Referring to FIG. 1, a plurality of filaments 1, e.g. emenating from an extruder, are wound onto a cardboard tube 2 to form a package 3. The filaments may be stretched and otherwise processed in conventional manner. The wind-up step at this stage is not essential, as the filaments can proceed directly to the strand-forming step. However, it provides a convenient way to accumulate filaments to be combined in a single strand.

Figure 2:
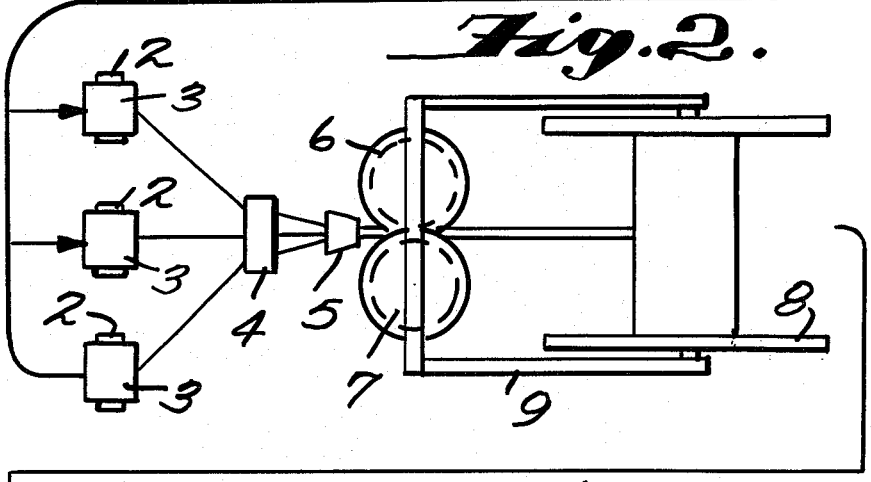
FIG. 2 is a schematic view of the making of a strand in the first step of the present invention.

FIG. 2 illustrates formation of a strand from three packages 3 of filaments. The filaments are wound from the packages through a guide 4 and a conical former 5. At this stage, no twist has yet been imparted, but the filaments are formed into a compact bundle by the former 5. The filaments then move one or more times around capstan rollers 6 and 7 and onto a spool 8, of a conventional rope making machine, e.g. at a speed of 50–250 feet per minute. The rollers 6 and 7 and the spool 8 are mounted on a frame 9 which rotates about a horizontal axis while the rollers and the spool rotates about their own axis, the spool winding up the strand. This causes a twist to be imparted to the strand. This twist depends upon the final diameter of the rope to be made, but may be 1–12 turns per inch.

Figure 3:
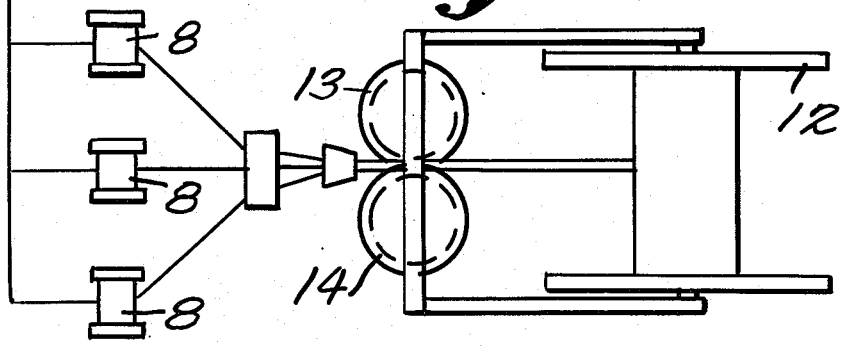
FIG. 3 is a schematic view of the second step of the present invention in which strands are closed into a rope.

As shown in FIG. 3, several strands from spools 8 are closed into a rope, using the same kind of rope machine as in FIG. 2, i.e., having a spool 12 and capstan rollers 13 and 14. A twist of 1 to 5 turns per inch may be used.

The untwisted filaments are heated while traveling between the extruder and the first package 3 and while they are drawn in conventional manner. In accordance with the present invention, it has been found possible to apply sufficient heat to the filaments at this stage so that it is not necessary to apply additional heat when the strands are formed. Typically the filaments are quenched in water as they emerge from the extruder and then are heated by radiant lamps, in an oven, or by similar means while being drawn. It has been found that, if the filaments are twisted into strands immediately or are stored in packages for several hours prior to twisting, they retain sufficient heat to be heat set when twisted into strands. In practice it has been found using radiant lamps at 950° to 1100° F. followed by radiant lamps at 650° to 800° F. in the drawing stage, the filaments can be stored up to 10–12 hours before twisting. Typically the draw ratio is 7 to 9:1. Preferably the drawing temperature is as near to the melting temperature of the filaments as possible. It also is preferred that the strands be made into rope before they have completely cooled.

The following example illustrates the practice of the invention.

Polypropylene is heated in an extruder which provides a succession of zones heated respectively at 380, 400, 420 and 450° F. The polymer then is passed through the head and extrusion die which are maintained at 450° F. and which has 100 holes 0.040 inch diameter. The emerging filaments travel through a distance of inches to a water bath which is maintained at 85 to 90° F. to quench the filaments. From the bath, the filaments travel through two radiant ovens in which the radiant heaters are maintained respectively at 1,100° F. and 800° F. Through the use of controlled speed rolls, the filaments are drawn, at a draw ratio of 8:1. Then the filaments are assembled, without twisting, in bundles of 25 filaments, each filament having a denier of 496. The bundles are wound on a tube to form packages.

After about 10 hours, 3 of these packages are mounted on a rope machine and plied and twisted 4 turns per inch into strands which are wound into packages. Three of these strands are then plied and twisted 2 turns per inch in the opposite direction to form a rope. The entire operation is completed before the filaments have cooled to room temperature (40° C. or lower) and in less than 12 hours after the filaments were extruded.

Although the invention has been described in detail with particular reference to certain preferred embodiments thereof, variations and modifications can be effected within the spirit and scope of the invention as described hereinabove and as defined in the appended claims.

We claim:

1. The method of forming a stranded rope structure which comprises extruding a plurality of filaments of a member of the group consisting of polyethylene, polypropylene and copolymers of ethylene and proplyene, drawing said filaments while heating them, but without twisting, said filaments having 65 to 1,650 deniers thereafter twisting said untwisted filaments to form a strand of 22,500 to 1,080,000 deniers before said filaments have cooled to room temperature, and twisting a plurality of the resulting strands into a rope of 67,500 to 3,240,000 deniers and wherein the strands are twisted into a rope before the strands have cooled to room temperature.

2. A method according to claim 1 in which the filaments are polypropylene.

* * * * *